US010316785B2

(12) United States Patent
Lee et al.

(10) Patent No.: US 10,316,785 B2
(45) Date of Patent: Jun. 11, 2019

(54) APPARATUS AND METHOD FOR CONTROLLING FLOW CONTROL VALVE FOR HIGH PRESSURE FUEL PUMP

(71) Applicant: MOTONIC CORPORATION, Seoul (KR)

(72) Inventors: Sang Ryul Lee, Seoul (KR); Wan Jae Jeon, Daegu (KR); Jun Hyeok Lee, Daegu (KR); Hyung Soo Kim, Daegu (KR); Hae Jin Kim, Daegu (KR); Kyu Sung Choi, Daegu (KR); Yeong Dong Park, Daegu (KR)

(73) Assignee: MOTONIC CORPORATION, Seoul (KR)

( * ) Notice: Subject to any disclaimer, the term of this patent is extended or adjusted under 35 U.S.C. 154(b) by 126 days.

(21) Appl. No.: 15/481,128

(22) Filed: Apr. 6, 2017

(65) Prior Publication Data

US 2017/0292468 A1 Oct. 12, 2017

(30) Foreign Application Priority Data

Apr. 7, 2016 (KR) ..... 10-2016-0042941

(51) Int. Cl.
*F02D 41/30* (2006.01)
*F02M 59/10* (2006.01)
(Continued)

(52) U.S. Cl.
CPC ..... *F02D 41/3005* (2013.01); *F02D 41/20* (2013.01); *F02D 41/3845* (2013.01);
(Continued)

(58) Field of Classification Search
CPC .. F02D 41/3005; F02D 41/20; F02D 41/3845; F02D 2041/2037;
(Continued)

(56) References Cited

U.S. PATENT DOCUMENTS

2004/0212944 A1* 10/2004 Tanzawa ..... F02D 41/20 361/160
2011/0129363 A1* 6/2011 Sakai ..... F02M 59/34 417/289
(Continued)

FOREIGN PATENT DOCUMENTS

KR 10-1171995 B1 8/2012
KR 10-1182130 B1 2/2014
(Continued)

*Primary Examiner* — Joseph J Dallo
*Assistant Examiner* — Kurt Philip Liethen
(74) *Attorney, Agent, or Firm* — Novick, Kim & Lee, PLLC; Jae Youn Kim

(57) ABSTRACT

An apparatus and a method for controlling a flow control valve for a high-pressure fuel pump include: a pressure sensor for fuel in a delivery pipe; a control unit for controlling an operation of a flow control valve by controlling a current applied to a coil; a power switching unit for supplying or blocking driving power supplied to the flow control valve based on a control signal of the control unit; and a current adjustment unit electrically connected/disconnected with the flow control valve by the power switching unit to reduce a current supplied to the flow control valve when the current adjustment unit is connected with the flow control valve. Therefore, a noise and a vibration by collision between the plunger and the core upon closing the flow control valve may be attenuated by adjusting a current amount applied to the coil.

8 Claims, 7 Drawing Sheets

(51) Int. Cl.

| | |
|---|---|
| ***F02M 59/46*** | (2006.01) |
| ***F02M 65/00*** | (2006.01) |
| ***F02D 41/20*** | (2006.01) |
| ***F02D 41/38*** | (2006.01) |
| *F02M 59/36* | (2006.01) |

(52) U.S. Cl.
CPC ..... *F02M 59/102* (2013.01); *F02M 59/466* (2013.01); *F02M 65/003* (2013.01); *F02D 2041/2003* (2013.01); *F02D 2041/2027* (2013.01); *F02D 2041/2037* (2013.01); *F02D 2200/0602* (2013.01); *F02D 2200/101* (2013.01); *F02M 59/366* (2013.01)

(58) Field of Classification Search
CPC ..... F02D 2041/2003; F02D 2041/2027; F02D 2200/101; F02D 2200/0602; F02M 59/102; F02M 59/466; F02M 65/003; F02M 59/366
See application file for complete search history.

(56) References Cited

U.S. PATENT DOCUMENTS

2014/0336902 A1* 11/2014 Igarashi ..... F02D 41/3005 701/103
2015/0090227 A1* 4/2015 Pursifull ..... F02M 59/366 123/446
2015/0300522 A1* 10/2015 Ito ..... H01F 7/1844 361/170

FOREIGN PATENT DOCUMENTS

KR 10-1361612 B1 2/2014
KR 10-2016-0008791 A 1/2016

* cited by examiner

APPARATUS AND METHOD FOR CONTROLLING FLOW CONTROL VALVE FOR HIGH PRESSURE FUEL PUMP

BACKGROUND OF THE INVENTION

Field of the Invention

The present invention relates to an apparatus and a method for controlling a flow control valve for a high-pressure fuel pump, and more specifically, to an apparatus and a method for controlling a flow control valve for a high-pressure fuel pump, which compress fuel at high pressure after an engine inhales and compresses air so as to supply the fuel to an injector for directly injecting the fuel into a cylinder.

Description of the Related Art

To improve fuel efficiency and performance of a gasoline engine, a technology for a gasoline direct injection (GDI) type engine is under development.

A usual gasoline engine generates motive power by a process of intake/compression/combustion/explosion/exhaust of an air/fuel mixture, whereas the GDI type engine inhales and compresses only air and then injects fuel, which is similar to a compression ignition system of a diesel engine.

Accordingly, the GDI type engine can implement the compression ratio which is high enough to overcome the compression ratio of the usual gasoline engine, thereby maximizing the fuel efficiency.

Fuel pressure is a very important factor in the GDI type engine, so a high-pressure fuel pump having high performance is required for the fuel pressure.

For example, an applicant of the present invention has disclosed the high-pressure fuel pump for the GDI type engine in several documents such as patent documents 1 and 2 which are denoted below and registered now.

Meanwhile, the high-pressure fuel pump for the GDI type engine according to the related art is mounted at an engine cam shaft, thus a pump shaft is rotated according to the rotation of a cam and a piston of the pump is moved by the torque, thereby forming pressure, such that gasoline fuel is supplied to an injector.

To this end, a flow control valve, which controls an opening/closing operation of an inlet-side check valve to control a discharging flow rate of the high-pressure fuel pump, is provided in the high-pressure fuel pump for the GDI type engine according to the related art.

In general, a solenoid valve operated in an electromagnetic way due to a coil is applied to the flow control valve.

The solenoid valve is opened in a state of no-current, and closed by generating a magnetic field for moving the plunger in the straight direction when a predetermined voltage is applied onto the coil.

(Patent document 1) Korean Registered Patent No. 10-1171995 (Published on Aug. 8, 2012)

(Patent document 2) Korean Registered Patent No. 10-1182130 (Published on Sep. 12, 2012)

(Patent document 3) Korean Registered Patent No. 10-1361612 (Published on Feb. 13, 2014)

However, the solenoid for operating the flow control valve generates a vibration and a noise due to an impact when the coil provided in the solenoid collides with a stopper provided at the inlet-side check valve upon operation of the high-pressure fuel pump.

Particularly, the inlet-side check valve of the solenoid generates a high frequency noise during an operation at a lower speed section where the engine is relatively silent, thus the high-pressure fuel pump according to the related art causes an increase of dissatisfaction to a driver due to the noise.

In addition, the high-pressure fuel pump for the GDI type engine according to the related art has a problem in that a spring mount unit provided in the solenoid is formed in an open type and coupled to an outer side of a body of the high-pressure fuel pump, such that the noise upon operation is discharged to an outer side of the high-pressure fuel pump.

To solve the problems mentioned as above, an applicant of the present invention has disclosed and registered the technology on the flow control valve for minimizing the noise and the vibration generated upon operation of the solenoid in patent document 3 denoted above.

However, there is a limit to remove the vibration and the noise completely upon operation of an actuator even though the configuration of patent document 3 is applied.

In addition, the high-pressure fuel pump for the GDI type engine according to the related art has problems in that an amount of a current consumption increases and a failure or damage on components incurs due to heat generated from the coil as a current is continuously supplied to the coil of the solenoid when the flow control valve operates.

SUMMARY OF THE INVENTION

To solve the problems as mentioned above, the object of the present invention is to provide an apparatus and a method for controlling a flow control valve for a high-pressure fuel pump, for controlling an amount of a current applied to a coil of the flow control valve which is applied to the high-pressure fuel pump.

Another object of the present invention is to provide an apparatus and a method for controlling a flow control valve for a high-pressure fuel pump, for attenuating the noise and the vibration upon the operation of the high-pressure fuel pump by reducing the collision speed between a plunger and a core provided in the flow control valve.

To achieve the object as mentioned above, the apparatus for controlling a flow control valve for a high-pressure fuel pump according to the present invention includes: a pressure sensor for sensing pressure of fuel filled in a delivery pipe; a control unit for controlling an operation of a flow control valve by controlling a current applied to a coil to attenuate a noise and a vibration caused by collision between the plunger and a core by adjusting an operation speed of a plunger provided in a solenoid upon opening/closing operation of the flow control valve provided in the high-pressure fuel pump based on a target RPM of an engine received from a main control unit of a vehicle and a sensing signal of the pressure sensor; a power switching unit for supplying or blocking driving power supplied to the flow control valve based on a control signal of the control unit; and a current adjustment unit electrically connected or disconnected with the flow control valve by an operation of the power switching unit to reduce a current supplied to the flow control valve when the current adjustment unit is connected with the flow control valve.

In addition, to achieve the object as mentioned above, the method of controlling a flow control valve for a high-pressure fuel pump according to the present invention, during a pull-in time of an opening/closing operation cycle of the flow control valve provided in the high-pressure fuel pump, in which a current is supplied to a coil to generate a magnetic field so as to move a plunger provided in a solenoid toward a core to close the flow control valve, a current supplied to the flow control valve is reduced by using a current adjustment unit connected to a rear end of the flow control valve, thereby preventing a noise and a vibration caused by the collision between a plunger and a core.

As mentioned above, according to the apparatus and the method for controlling the flow control valve for the high-pressure fuel pump of the present invention, the noise and the vibration caused by the collision between the plunger and the core upon the closing operation of the flow control valve can be attenuated by adjusting an amount of the current applied to the coil of the flow control valve.

In other words, according to the present invention, the current applied to the flow control valve is rapidly reduced when reaching a preset-time during the pull-in time, thus the plunger is moved by inertia, so that the noise and the vibration caused by the collision between the plunger and the core can be attenuated.

In addition, according to the present invention, suction force is provided to the plunger by re-applying a current to the flow control valve when reaching a preset-time during a drop time, such that a noise and a vibration due to collision between the plunger and a needle guide can be attenuated.

Therefore, according to the present invention, the noise and the vibration due to collision between the plunger and the core can be attenuated by reducing an operation speed of the plunger provided in the flow control valve.

DETAILED DESCRIPTION OF THE INVENTION

An apparatus and a method for controlling a flow control valve for a high-pressure fuel pump according to a preferred embodiment of the present invention will be described in detail with reference to the accompanying drawings.

Hereinafter, for the convenience of explanation, a flow control valve provided in a high-pressure fuel pump for a GDI type engine will be used in the description.

However, the present invention is not limited thereto, and it may be applied not only to the GDI type engine but also to various internal combustion engines such as a direct injection type LPG engine capable of directly injecting various kinds of fuel into a combustion chamber by pressurizing the fuel at the high pressure.

Figure 1:
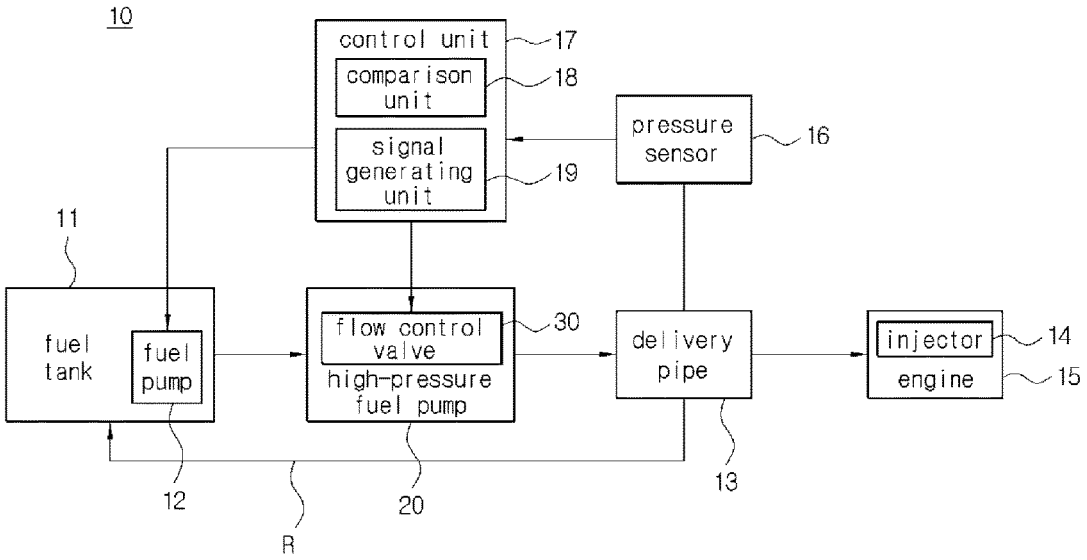
FIG. 1 is a block diagram showing a fuel supply system using an apparatus for controlling a flow control valve for a high-pressure fuel pump according to a preferred embodiment of the present invention.

FIG. 1 is a block diagram showing a fuel supply system using an apparatus for controlling a flow control valve for a high-pressure fuel pump according to a preferred embodiment of the present invention.

As shown in FIG. 1 according to a preferable embodiment of the present invention, the fuel supply system to which the apparatus for controlling a flow control valve for a high-pressure fuel pump is applied may include: a fuel pump 12 for pumping gasoline fuel filled in a fuel tank 11 to supply the fuel to an engine 15; a high-pressure fuel pump 20 for pressurizing the fuel supplied from the fuel pump 12 at a preset high pressure; a delivery pipe 13 filled therein with the fuel pressurized at the high pressure; an injector 14 directly injecting the fuel filled in the delivery pipe 13 at the high pressure into each combustion chamber of the engine 15; a pressure sensor 16 for sensing the pressure of the fuel filled in the delivery pipe 13; and a control unit 17 for controlling operations of the fuel pump 12, the high-pressure fuel pump 20, and the injector 14 based on a target RPM of the engine 15.

The apparatus 10 for controlling the flow control valve for the high-pressure fuel pump according to the present invention is not limited to the configuration of the fuel supply system as described above, and the present invention may be modified to further include various components and fuel flow paths such as an air pressure regulator for regulating the preset pressure of the fuel, and a fuel collecting line R or a bypass line for collecting remaining fuel except for the fuel injected to the engine among the fuel supplied to the delivery pipe 13, to the fuel tank 12.

A pressure sensor 16 is installed at the delivery pipe 13 to sense the pressure of the fuel filled in the delivery pipe 13, and the control unit 17 may control operations of the fuel pump 12 and the high-pressure fuel pump 20, based on the fuel pressure sensed at the pressure sensor 16.

The control unit 17 may perform communication with a main control unit (not shown) of a vehicle, and may be prepared as an electronic control unit for controlling the operations of the fuel pump 12, the high-pressure fuel pump 20, and the injector 14.

In addition, the control unit 17 may be prepared as an additional control unit connected and communicated with the electronic control unit.

The configuration and operation of the control unit 17 will be described in detail as below with reference to FIG. 4.

Next, the configuration of the high-pressure fuel pump according to a preferred embodiment of the present invention will be described in detail with reference to FIGS. 2 and 3.

Figure 2:
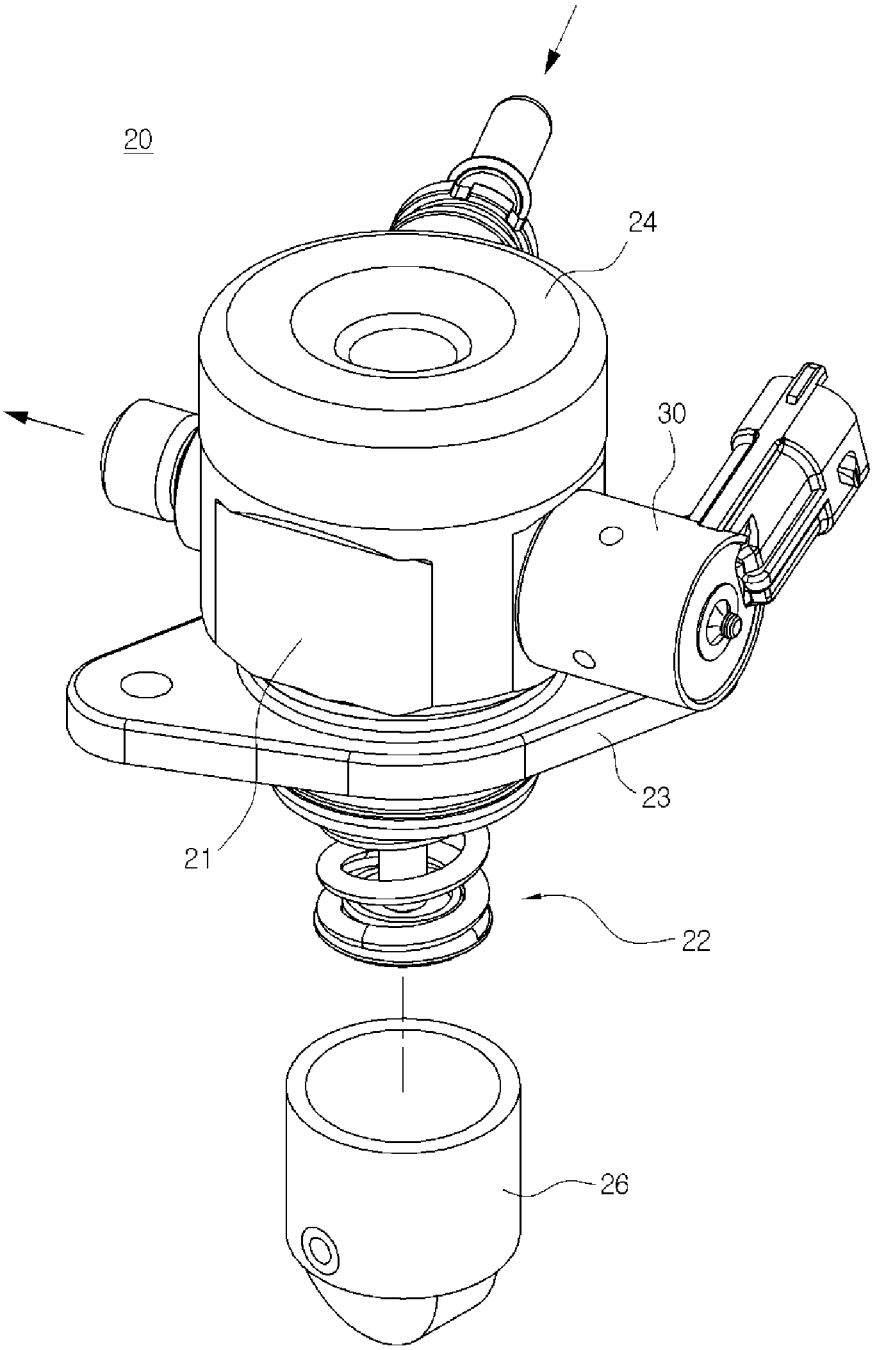
FIG. 2 is a perspective view showing a high-pressure fuel pump applied to a preferred embodiment of the present invention.
Figure 3:
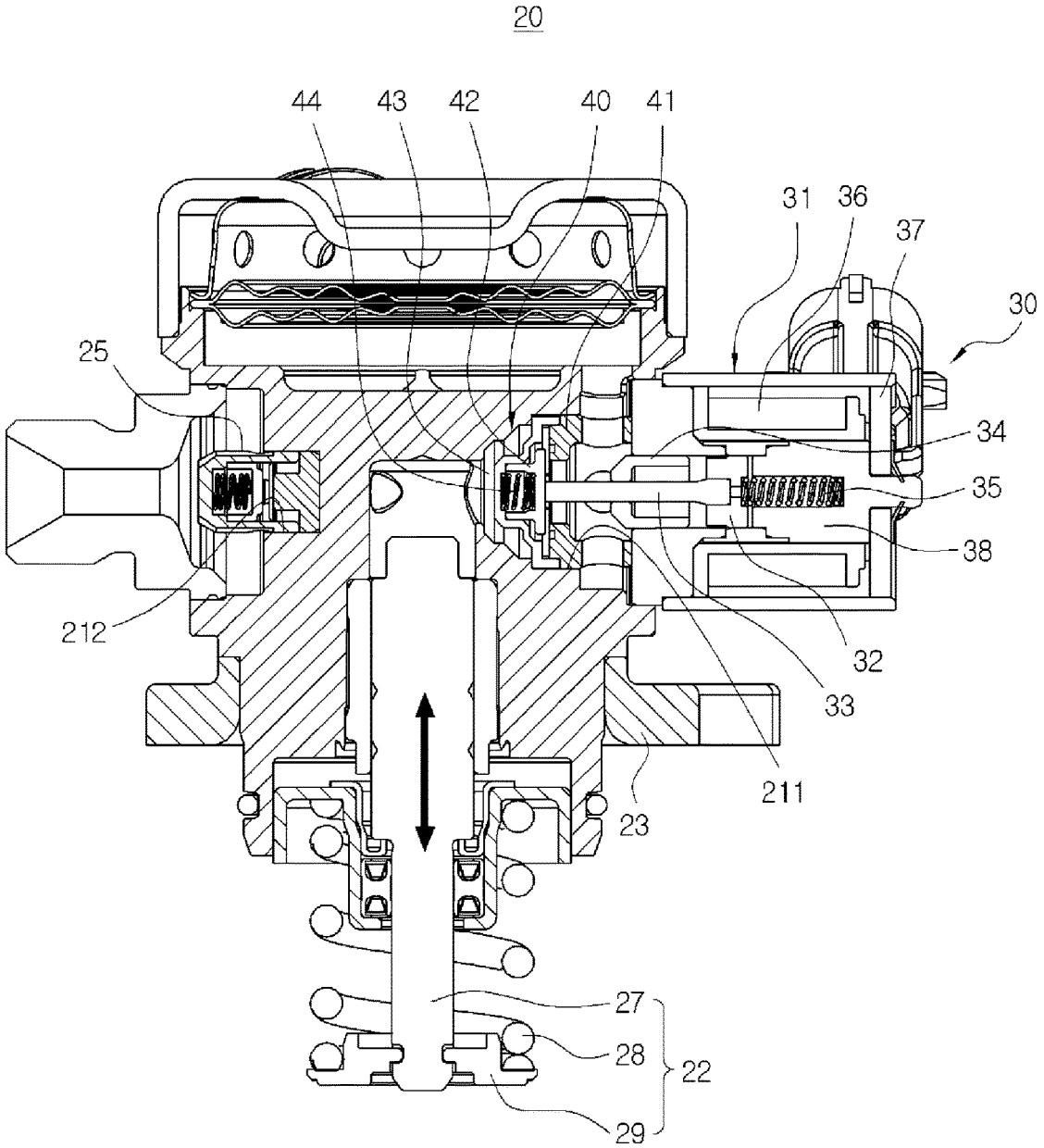
FIG. 3 is a cross-sectional view of the flow control valve shown in FIG. 2.

FIG. 2 is a perspective view showing a high-pressure fuel pump applied to a preferred embodiment of the present invention, and FIG. 3 is a cross-sectional view of the flow control valve shown in FIG. 2.

In the following description, the term indicating a direction such as "left", "right", "front", "rear", "upper" and "lower" may indicate a direction based on a state shown in each drawing.

As shown in FIGS. 2 and 3, the high-pressure fuel pump 20 may include: a body 21 formed at a side surface thereof with inlet-side and outlet-side openings 211 and 212; a bracket 23 coupled to a lower part of the body 21 and provided therein with a suction device 22 for generating suction force with respect to the fuel; a damper unit 24 coupled to an upper part of the body 21 to reduce a pulse of sucked fuel; a flow control valve 30 coupled to the inlet-side opening 211 for opening/closing an inlet-side check valve 40 to control a supply flow rate and a discharging pressure of the fuel; and an outlet-side check valve 25 coupled to the outlet-side opening 212.

In addition, the high-pressure fuel pump 20 may further include a roller tappet unit 26 coupled between the body 21 and an engine cam shaft (not shown) to be integrated with the suction device 22 to transfer a movement to the suction device 22 by converting a rotating movement of the cam into a linear reciprocating movement.

The suction device 22 may include: a piston 27 moved up and down by the linear reciprocating movement of the roller tappet unit 26; a return spring 28 for providing restoring force to the piston 27; and a retainer 29 coupled to lower end portions of the return spring 28 and the piston 27.

The flow control valve 30 controls the opening/closing operation of the inlet-side check valve 40 according to an operation of the solenoid 31, thereby transferring the fuel, which is transferred to the flow control valve 30 via the damper unit 24, to the outlet-side check valve 25 through the inlet-side check valve 40.

Accordingly, the flow control valve 30 controls the opening/closing operation of the inlet-side check valve 40 according to the operation of the solenoid 31, thereby controlling the supply flow rate and the discharging pressure of the fuel supplied to the body 21 of the high-pressure fuel pump 20.

As shown in FIG. 3, the flow control valve 30 may include: a solenoid 31 for linearly reciprocating the plunger 32 provided in the solenoid 31 by receiving a current; an inlet-side check valve 40 for supplying fuel to an outlet-side check valve 25 while preventing a back flow of the fuel introduced into the inlet-side check valve 40 according to the movement of the plunger 32; a needle 33 for opening/closing the inlet-side check valve 40 by linearly reciprocating according to the operation of the solenoid 31; a needle guide 34 for guiding the linear reciprocating movement of the needle 33; and a spring 35 installed in the solenoid 31 to provide restoring force to the needle 33.

The solenoid 31 may include: a bobbin 37 wound on an outer surface thereof with a coil 36; a core 38 installed inside the bobbin 37; and a plunger 32 linearly reciprocating by a magnetic field when a current is supplied to the coil 36.

That is, the flow control valve 30 closes the inlet-side check valve 40 by moving the plunger 32 and the needle 33 toward the core 38 by generating the magnetic field when a current is supplied to the coil of the solenoid 31, and opens the inlet-side check valve 40 by moving the plunger 32 and the needle 33 toward the inlet-side check valve 40 due to the restoring force of the spring 35 when the current is blocked.

The inlet-side check valve 40 may include: a body 41 formed in a cylindrical shape opened at an upper surface and having a filling space in the middle thereof filled with the fuel; a valve body 42 for opening/closing a transfer hole which transfers the fuel filled in the filling space to the body 21; a stopper coupled to a lower part of the body 41; and an elastic spring 44 installed between the stopper 43 and the valve body 42 to provide elasticity to the valve body 42.

Meanwhile, according to the present invention, the apparatus 10 for controlling the flow control valve for the high-pressure fuel pump is not limited to the configuration of the high-pressure fuel pump 20 as described above, and may be applied to various modifications such as a shape and a combining structure of each component provided in the high-pressure fuel pump 20 and a structure of a flow passage formed therein.

Back to FIG. 1, the control unit 17 may control an operation of the flow control valve 30 by generating a control signal for controlling an amount of a current applied onto the coil 36 of the solenoid 31 according to a pressure sensing signal sensed at the pressure sensor 16.

That is, the control unit 17 may control strength of a magnetic field generated at the coil 36 to control the operating speed of the plunger 32, thereby adjusting the amount of the current by varying a voltage of supply power applied to the coil 36 of the solenoid 31, so as to minimize the noise and the vibration caused by the collision between the plunger 32 and the core 38 when the flow control valve 30 is closed.

To this end, the control unit 17 may include: a comparison unit 18 for comparing a target RPM received from a main control unit of the vehicle with a sensed pressure of the fuel sensed at the pressure sensor 16; and a signal generating unit 19 for generating a control signal to control an operation of the solenoid 31 according to the comparison result of the comparison unit 18.

The signal generating unit 19 may adjust the amount of the current applied to the coil 36 of the solenoid 31 by varying a voltage based on the comparison result of the comparison unit 18.

Figure 4:
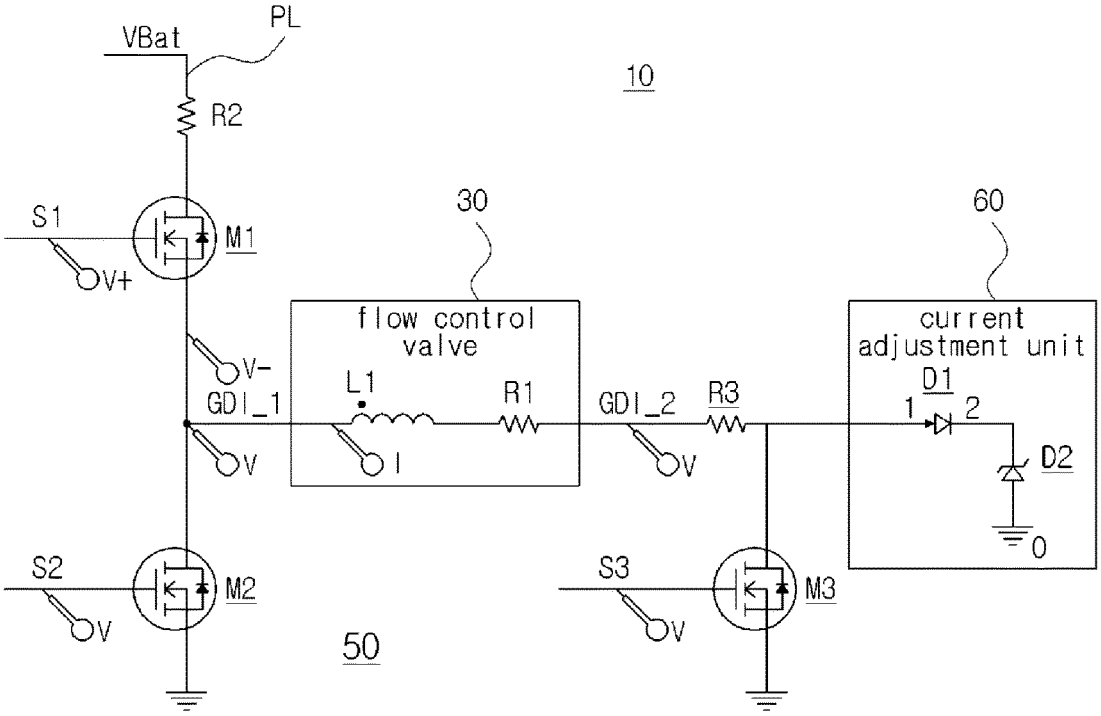
FIG. 4 is a circuit diagram showing an apparatus for controlling a flow control valve for a high-pressure fuel pump according to a preferred embodiment of the present invention.

For example, FIG. 4 is a circuit diagram showing an apparatus for controlling a flow control valve for a high-pressure fuel pump according to a preferred embodiment of the present invention.

As shown in FIG. 4, the apparatus 10 for controlling the flow control valve for the high-pressure fuel pump according to a preferred embodiment of the present invention include: a power switching unit 50 for supplying or blocking driving power supplied to the flow control valve 30 of the high-pressure fuel pump 20 based on a control signal of the control unit 17; and a current adjustment unit 60 connected to a rear end of the flow control valve 30 to reduce a current supplied to the flow control valve 30.

The power switching unit 50 may include: a first switch M1 installed on a power supply line PL for applying the driving power VBat to the flow control valve 20 from a battery (not shown) of the vehicle; a second switch M2 installed between the first switch M1 and a ground potential line GND; and a third switch M3 installed between the flow control valve 30 and the ground potential line GND.

In FIG. 4, the flow control valve 30 may include components of an inductance L1 and a resistor R1 of the coil 36 provided at the solenoid 31, and resistors R2 and R3 may be installed between the power supply line PL and the first switch M1, and at the rear end of the flow control valve 30, respectively.

The first to third switches M1 to M3 may be prepared as various switching elements such as a metal oxide semiconductor electric field effect transistor or an electric field effect transistor.

A drain electrode and a source electrode of the first switch M1 may be connected to the power supply line PL, and the first switch M1 may open/close the power supply line according to a control signal S1 of the control unit 17 applied via a gate electrode.

A drain electrode and a source electrode of the second switch M2 may be connected to the power supply line PL and the ground potential line GND, and the second switch M2 may be opened/closed according to a control signal S2 of the control unit 17 applied via a gate electrode.

A drain electrode and a source electrode of the third switch M3 may be connected to the flow control valve 30 and the ground potential line GND, and the third switch M3 may be opened/closed according to a control signal S3 of the control unit 17 applied via a gate electrode.

The current adjustment unit 60 may be prepared as a snubber circuit including first and second diodes D1 and D2 connected to the flow control valve 30 and the ground potential line GND in the forward and reverse directions, respectively.

At this point, the second diode D2 may be prepared as a zener diode having a zener effect, in which a current rapidly flows when a reverse voltage equal to or greater than a specific voltage (zener voltage) is applied thereto.

Alternatively, the second diode D2 may be prepared as a transient voltage suppressor (TVS) diode for enabling a current to flow to the ground potential line GND when a voltage equal to or greater than an intrinsic clamping voltage is supplied thereto.

Accordingly, when turning off the third switch M3 while turning on the first switch M1, the current adjustment unit 60 may rapidly reduce a current applied to the flow control valve 30 by grounding the current at the ground potential line GND.

Figure 5:
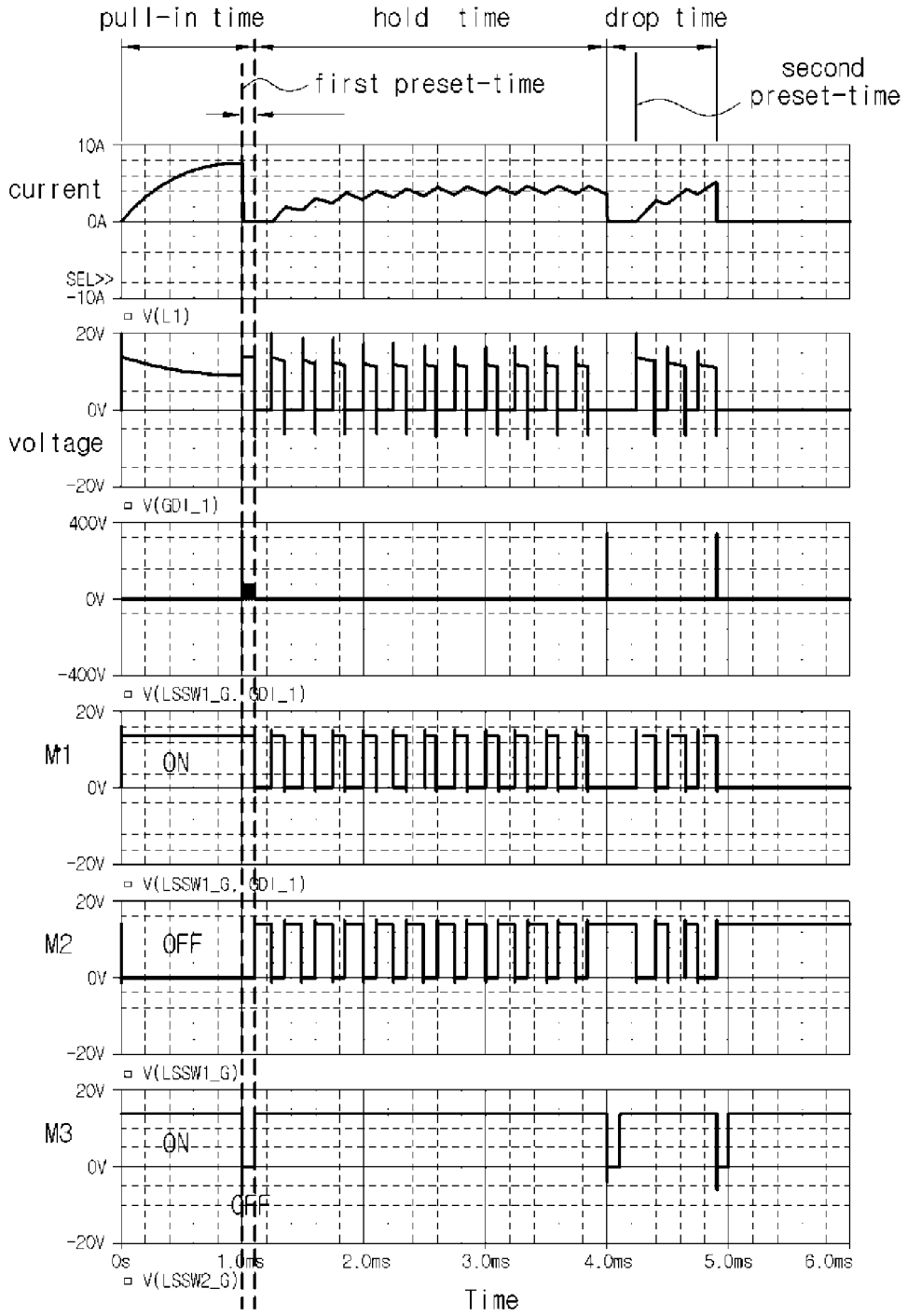
FIG. 5 is a timing diagram exemplifying a control operation of a flow control valve.

For example, FIG. 5 is a timing diagram exemplifying a control operation of the flow control valve.

FIG. 5 is a graph showing a current and a voltage applied to the flow control valve 30 and control signals supplied to the first to third switches according to an opening/closing operation cycle of the flow control valve 30.

The opening/closing operation cycle of the flow control valve 30 includes: a pull-in time for increasing an amount of a current supplied to the coil 36 to generate a magnetic field so as to move the plunger 32 toward the core 38 upon a closing operation of the flow control valve 30; a hold time for maintaining the closed flow control valve 30 in a closed state; and a drop time for reducing the amount of the current to open the flow control valve 30.

At this point, the pull-in time and the hold time indicate a working time for applying the voltage of the control signal.

In the high-pressure fuel pump 20, a period of the cycle for closing and opening the flow control valve 30 may be changed according to a driving state of the vehicle, especially, an RPM of the engine 15 since the piston 27 prepared in the suction device 22 is pumped in a linear reciprocating motion by receiving the rotating motion of the cam installed at the cam shaft of the engine 15 through the roller tappet unit 26.

The flow control valve 30 may suck the fuel into the filling space therein through the damper unit 24 by opening the inlet-side check valve 40 upon descending operation of the piston 27, and transfer the fuel filled in the filling space into the body 24 by closing the inlet-side check valve 40 upon ascending operation of the piston 27 while preventing the back flow of the fuel.

The signal generating unit 19 generates a control signal having a preset peak voltage value during the pull-in time, and the current applied to the coil 36 increases up to a predetermined peak current value according to a slope defined by a resistance value of the coil 36.

At this point, the peak current value, which is a current value set by an experimental value to promptly close the inlet-side check valve 40, may be set as a value equal to or smaller than a maximum current value for implementing a maximum operation speed of the inlet-side check valve.

In addition, the signal generating unit 19 may generate control signals S1 and S2 to turn on the first switch M1 and turn off the second switch during the peak time.

In addition, the signal generating unit 19 may generate a control signal S3 to turn off the third switch M3 when reaching a preset first preset-time, after turning on the first switch as well as the third switch.

At this point, the first preset-time indicates a time that the plunger 32 moves for predetermined stroke caused by the inertia after starting a movement by the suction force.

The first preset-time may be set as a point elapsed for a predetermined time from a starting point of the pull-in time, or set as a point lapsed for the predetermined ratio with respect to the entire pull-in time, for example 70% to 90%.

For example, a time applied with a pull-in current may be set as about 0.6 ms to about 1.0 ms.

However, the present invention is not limited thereto, and may be modified variously depending on an entire time of the opening/closing operation cycle of the flow control valve according to a driving state of the vehicle.

Accordingly, the first switch M1 and the third switch M3 are turned on during the pull-in time, and the third switch M3 is turned off when reaching the first preset-time, thus the current applied to the flow control valve 30 is rapidly decreased by the current adjustment unit 60

That is, as shown in FIG. 5, a first voltage GDI_1 applied to the flow control valve 30 slightly increases after the first preset-time, and a second voltage GDI_2 outputted from the flow control valve 30 rapidly increases after the first preset-time and then rapidly decreases by an operation of the current adjustment unit 60.

Therefore, when reaching a preset time upon the closing operation of the flow control valve, the present invention may control the plunger to make contact with the core by minimizing the suction force applied to the plunger and moving the plunger, which is rapidly moved by the suction force, by using the inertia other than the suction force.

Accordingly, the present invention may attenuate the noise and the vibration by minimizing an impact between the plunger and the core when the flow control valve is closed.

Meanwhile, the present invention may be modified to turn off the first switch M1 while turning off the third switch M3 during the pull-in time, to completely block the current applied to the flow control valve.

The signal generating unit 19 generates a control signal in the form of PWM signal having a preset duty value during the hold time to minimize the current consumption due to a constant increase of the current applied to the coil 36 and prevent the overheat of the solenoid 31.

At this point, the signal generating unit 19 may generate a control signal to alternately turn on or off the first switch M1 and the second switch M2 while maintaining the third switch M3 to be turned on.

Then, the current applied to the coil 36 may be maintained as a hold current value set lower than the peak current value until the closed inlet-side check valve 40 is opened.

At this point, the control signal in the form of PWM signal is applied to alternately turn on or off the first and second switches, such that the current applied to the coil 36 may vary around the hold current value.

For example, the control signal generated during the hold time may have a duty value of about 15% to about 25%.

The variation of the current may be limited within a preset range.

Accordingly, the present invention may maintain the current applied to the coil at the hold current value by supplying a current corresponding to a hold current value which is set lower than the peak current valve, when the closing operation of the inlet-side check valve is completed.

Accordingly, the present invention may prevent a failure or a damage of components by minimizing the current consumption due to the constant increase of the current applied to the coil and preventing the overheat of the solenoid.

The signal generating unit 19 may block the control signal until the drop time and a next closing operation, and completely block the control signal until the inlet-side check valve 40 in a state of closing operation is opened after the current applied to the coil 36 descends.

Meanwhile, the signal generating unit 19 may generate a control signal to apply a current to the flow control valve 30 during a preset time in a process that the plunger 32 is moved by elasticity of a spring 35 provided at the flow control valve 35 during the drop time so as to minimize the noise and the vibration caused by the collision between the plunger 32 and the needle guide 34 upon an opening operation of the inlet-side check valve 40.

Specifically, when reaching a second preset-time in a state of turning on the third switch M3, the signal generating unit 19 may generate a control signal in the form of PWM signal having a preset duty value to alternately turn on or off the first switch M1 and the second switch M2.

At this point, the second preset-time may be set as a time required for rotating the piston 27 of the high-pressure fuel pump 20 at an angle of about 10° to about 20° from a top dead center.

In addition, the signal generating unit 19 may set the duty value of the control signal in the form of a PWM signal generated upon the second preset-time to be equal to or smaller than the duty value of the control signal generated during the hold time.

Accordingly, the present invention may attenuate the noise and the vibration caused by collision between the plunger and a needle guide by re-applying a current to the flow control valve for a preset time to generate the suction force smaller than that of the pull-in time.

Next, a method of controlling a flow control valve for a high-pressure fuel pump according to a preferred embodiment of the present invention will be described in detail with reference to FIG. 6.

Figure 6:
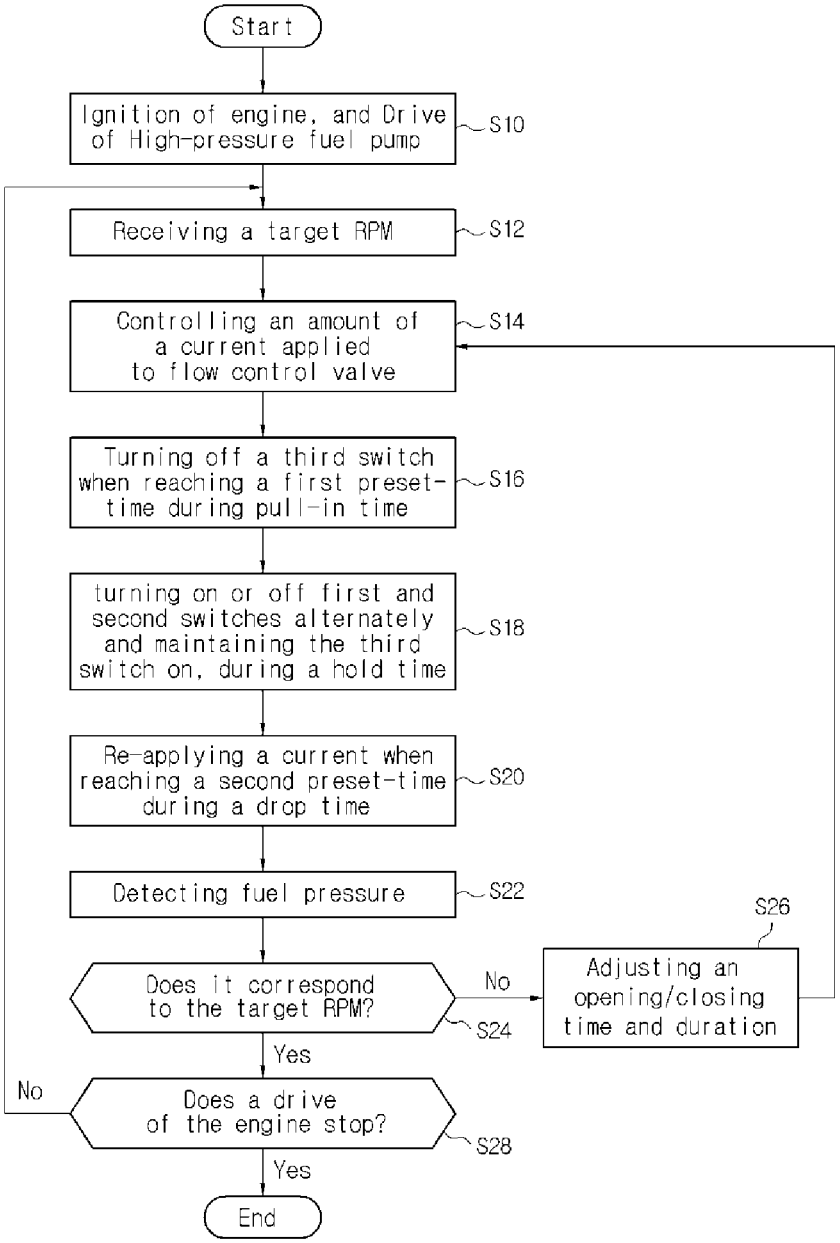
FIG. 6 is a flow chart describing a method of controlling a flow control valve for a high-pressure fuel pump according to a preferred embodiment of the present invention step by step.

FIG. 6 is a flow chart describing a method of controlling a flow control valve for a high-pressure fuel pump according to a preferred embodiment of the present invention step by step.

In step S10 of FIG. 6, when an engine 15 is ignited by manipulating an ignition key (not shown), the piston 27 provided in the high-pressure fuel pump 20 linearly reciprocates by a rotating operation of the cam installed at the cam shaft, such that the high-pressure fuel pump 20 is driven, thereby starting a pumping operation (S10).

Then, the control unit 17 receives a target RPM of the engine by performing communication with a main control unit of a vehicle (S12).

The control unit 17 calculates an opening/closing time and an opening/closing duration according to the received target RPM and generates a control signal for adjusting an amount of a current applied to the coil 36 of the flow control valve 30 to close the inlet-side check valve 40 when the piston 27 ascends and open the inlet-side check valve 40 when the piston 27 descends.

Specifically, the control unit 17 may generate a control signal according to the pull-in time, hold time, and drop time based on the opening/closing operation cycle of the flow control valve 30.

Figure 7A:
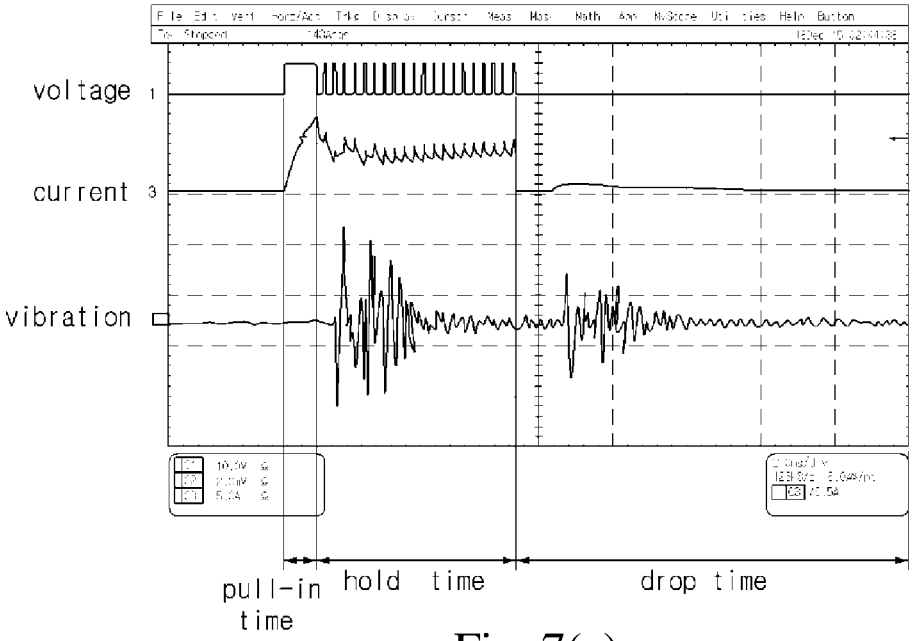
FIGS. 7(*a*) and 7(*b*) are timing diagrams exemplifying a control operation of a flow control valve.
Figure 7B:
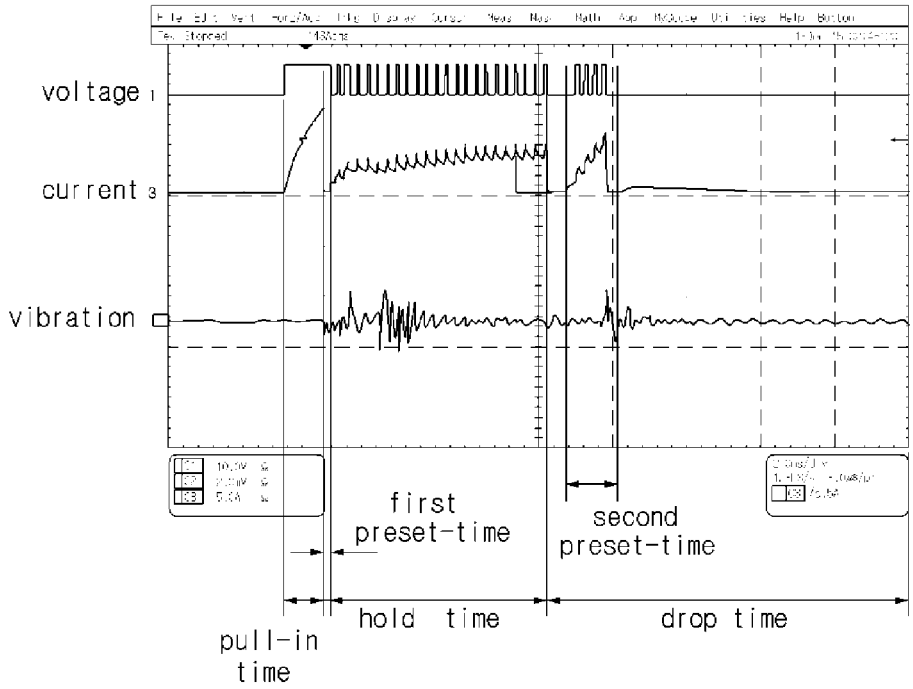

For example, FIG. 7 is a timing diagram exemplifying a control operation of the flow control valve, and table 1 shows a timing of the control operation as described in FIG. 7.

TABLE 1

| | Pull-in time | |
|---|---|---|
| Item | Comparing example | Embodiment example |
| M1 | ON | ON |
| M2 | OFF | OFF |
| M3 | ON | ON →OFF |

FIG. 7(*a*) and FIG. 7(*b*) show graphs for a voltage, a current, and a vibration applied to the flow control valve 30 according to a comparing example for explaining the present invention and a preferred embodiment of the present invention with respect to the opening/closing operation cycle.

According to the comparing example as shown in FIG. 7(*a*) and Table 1, both the first and the third switches M1 and M2 are turned on during the pull-in time.

The signal generating unit 19 generates control signals S1 and S3 to turn on the first switch M1 and the third switch M3 during the pull-in time, and then to turn off the third switch M3 upon reaching the first preset-time (S16).

Accordingly, the plunger 32 moves toward the core 38 by the suction force generated from the solenoid 31, and moves for a preset stroke by inertia when reaching the first preset-time.

According to the embodiment of the present invention, as shown FIGS. 7(*a*) and 7(*b*), the third switch M3 is turned off after the first preset-time, and the current applied to the flow control valve is rapidly decreased by using the current adjustment unit 60, thus the plunger 32 is moved by the inertia, such that the noise and the vibration caused by the collision between the plunger 32 and the core 38 may be remarkably decreased in comparison with the comparing example.

At this point, when reaching the first preset-time, the control unit 17 may turn off the first switch M1 together with the third switch M3, such that the current applied to the flow control valve 30 is completely blocked.

In addition, the signal generating unit 19 generates a control signal to alternately turn on or off the first switch M1 and the second switch M2 while maintaining the third switch M3 in an on-state during the hold time (S18).

Accordingly, the present invention may minimize the current consumption due to the constant increase of the current applied to the coil 36 and prevent the overheat of the solenoid 31.

In addition, when reaching the second preset-time in a process that the plunger 32 is moved by elasticity of the spring 35 provided in the flow control valve 35 during the drop time, the signal generating unit 19 may minimize the noise and the vibration caused by collision between the plunger 32 and a needle guide 34 by generating a control signal to re-apply a current to the flow control valve 30.

Accordingly, the present invention may minimize the noise and the vibration due to the collision between the plunger and the core by controlling the operation speed of the plunger by adjusting an amount of the current applied to the coil.

At this point, the pressure sensor 16 senses pressure of fuel filled in a delivery pipe 13, and transfers a sensing signal corresponding to the sensed fuel pressure to the control unit 17 (S22).

Then, the control unit 17 compares the sensed fuel pressure with fuel pressure corresponding to a target RPM (S24).

As a result of the comparison in S24, when the sensed fuel pressure is different from the fuel pressure corresponding to the target RPM, the control unit 17 adjusts an opening/closing time and an opening duration of the valve (S26), and proceeds to step S14 to continuously control the amount of the current applied to the flow control valve 30.

On the contrary, when the sensed fuel pressure is same as the fuel pressure corresponding to the target RPM as a result of the comparison in S24, the control unit 17 maintains the opening/closing time and the opening duration of the valve.

In step S28, the control unit 17 inspects whether an operation of the engine 15 stops by operating the ignition key in an off-state, and controls to repeat steps S12 to S28 until the operation of the engine 15 stops.

As a result of the inspection in step S28, when the engine 15 stops the operation, the control unit 17 suspends and stops the operation of the apparatus 10 of the flow control valve 30.

According to the steps described above, the present invention may attenuate the noise and the vibration caused by the collision between the plunger and the core upon the closing operation of the flow control valve by adjusting the amount of the current applied to the coil of the flow control valve.

Particularly, when reaching a preset-time during the pull-in time, the present invention may attenuate the noise and the vibration due to the collision between the plunger and the core by moving the plunger through the inertia by rapidly reducing the current applied to the flow control valve.

In addition, when reaching a preset-time during the drop time, the present invention may attenuate the noise and the vibration caused by the collision between the plunger and the needle guide by applying the suction force to the plunger by re-applying the current to the flow control valve.

The present invention implemented by the inventor is described in detail according to the above embodiments, however, is not limited to the embodiments and various modifications are available within the scope without departing from the idea of the present invention.

In other words, the flow control valve provided in the high-pressure fuel pump for the GDI type engine is described in the above embodiments of the present invention.

However, the present invention may be modified to be applicable not only to the GDI type engine but also to various internal combustion engines such as a direct injection type LPG engine capable of directly injecting various fuel (e.g. LPG or CNG) into a combustion chamber by pressurizing the fuel at the high pressure.

The present invention may be applied to a technology related to the apparatus and the method for controlling the flow control valve for the high-pressure fuel pump, in which the apparatus and the method attenuate the noise and the vibration caused by collision between the plunger and the core upon closing operation of the flow control valve by adjusting an amount of a current applied to the coil of the flow control valve.

What is claimed is:

1. An apparatus for controlling a flow control valve for a high-pressure fuel pump, the apparatus comprising:

a pressure sensor for sensing pressure of fuel filled in a delivery pipe;

a controller for controlling an operation of a flow control valve by controlling a current applied to a coil to attenuate a noise and a vibration caused by collision between a plunger and a core by adjusting an operation speed of the plunger provided in a solenoid upon opening/closing the operation of the flow control valve provided in the high-pressure fuel pump based on a target revolutions per minute (RPM) of an engine received from a main controller of a vehicle and a sensing signal of the pressure sensor;

a power switch for supplying or blocking driving power supplied to the flow control valve based on a control signal of the controller; and a current adjustment part electrically connected to or disconnected from the flow control valve by an operation of the power switch to reduce a current supplied to the flow control valve when the current adjustment part is connected with the flow control valve, wherein the power switch comprises:

a first switch installed on a power supply line for applying the driving power to the flow control valve from a battery of the vehicle;

a second switch installed between the first switch and a ground potential line; and a third switch installed between the flow control valve and the ground potential line.

2. The apparatus of claim 1, wherein an opening/closing operation cycle of the flow control valve comprises:

a pull-in time for supplying a current to a coil to generate a magnetic field so as to move the plunger provided in the solenoid toward the core to close the flow control valve;

a hold time for maintaining the flow control valve in a closed state; and a drop time for reducing the current applied to the coil to open the flow control valve.

3. The apparatus of claim 2, wherein the current adjustment part is prepared as a snubber circuit including first and second diodes connected between the flow control valve and the ground potential line in a forward and a reverse directions, respectively.

4. The apparatus of claim 2, wherein the controller comprises a comparison part for comparing pressure of fuel corresponding to the target RPM with the sensed pressure of fuel sensed from the pressure sensor, and a signal generating part for generating a control signal by calculating an opening/closing start time and an opening/closing duration of the flow control valve to control an operation of the solenoid according to a comparison result of the comparison part, and wherein the signal generating part generates a control signal for turning on the first and third switches and turning off the second switch during the pull-in time, and turning off the third switch, when reaching a first preset-time, to reduce the current applied to the flow control valve by using the current adjustment part so as to enable the plunger of the flow control valve to move by inertia.

5. The apparatus of claim 4, wherein the signal generating part generates a control signal for re-applying the current to the flow control valve, when reaching a second preset-time in a process that the plunger is moved by elasticity of a spring provided at the flow control valve during the drop time, thereby reducing a noise and a vibration generated upon collision between the plunger of the flow control valve and a needle guide upon an opening operation of an inlet-side check valve.

6. A method of controlling a flow control valve for a high-pressure fuel pump, the method comprising:

supplying a current to a coil to generate a magnetic field so as to move a plunger provided in a solenoid toward a core to close the flow control valve, during a pull-in time of an opening/closing operation cycle of the flow control valve provided in the high-pressure fuel pump; and reducing the current supplied to the flow control valve by using a current adjustment part connected to a rear end of the flow control valve, thereby preventing a noise and a vibration caused by collision between the plunger and the core, wherein the method further comprises:

(a) turning on a first switch installed on a power supply line for applying driving power to the flow control valve from a battery of a vehicle at a starting point of the pull-in time;

(b) turning off a second switch installed between the first switch and a ground potential line; and (c) turning off a third switch to remove suction force applied to the plunger when reaching a first preset-time after simultaneously turning on the first switch and the third switch which is installed between the flow control valve and the ground potential line.

7. The method of claim 6, wherein, in step (c), the current adjustment part installed between the flow control valve and the ground potential line removes the suction force applied to the plunger by receiving and reducing the current applied to the flow control valve according to the turning off operation of the third switch, and the plunger moves for a predetermined stroke by using inertia caused by the suction force of the solenoid, thereby making contact with the core.

8. The method of claim 6, further comprising (d) attenuating a noise and a vibration caused by collision between the plunger and a needle guide upon an opening operation of the flow control value by re-applying a current to the flow control valve to apply the suction force to the plunger when reaching a second preset-time from a starting point of a drop time for opening the flow control valve by reducing the current applied to the coil, wherein, in step (d), the first switch and the second switch are alternately on or off by a PWM control signal having a preset duty value.

* * * * *